US009717305B2

(12) United States Patent
Midorikawa

(10) Patent No.: US 9,717,305 B2
(45) Date of Patent: Aug. 1, 2017

(54) SHOELACE WINDING REEL

(71) Applicant: JAPANA CO., LTD., Nagoya, Aichi (JP)

(72) Inventor: Shinobu Midorikawa, Nagoya (JP)

(73) Assignee: JAPANA CO., LTD., Nagoya, Aichi (JP)

( * ) Notice: Subject to any disclaimer, the term of this patent is extended or adjusted under 35 U.S.C. 154(b) by 240 days.

(21) Appl. No.: 14/405,738

(22) PCT Filed: Oct. 17, 2013

(86) PCT No.: PCT/JP2013/078117
§ 371 (c)(1),
(2) Date: Dec. 4, 2014

(87) PCT Pub. No.: WO2014/203416
PCT Pub. Date: Dec. 24, 2014

(65) Prior Publication Data

US 2016/0262497 A1 Sep. 15, 2016

(30) Foreign Application Priority Data

Jun. 18, 2013 (JP) ..... 2013-127612

(51) Int. Cl.
*A43C 11/16* (2006.01)

(52) U.S. Cl.
CPC ..... *A43C 11/165* (2013.01)

(58) Field of Classification Search
CPC ..... A43C 11/165; A43C 11/16; A43C 11/00; A43C 11/004; Y10T 24/2183;
(Continued)

(56) References Cited

U.S. PATENT DOCUMENTS 4,433,456 A * 2/1984 Baggio ..... A43C 11/16 24/68 B
5,042,177 A 8/1991 Schoch
(Continued)

FOREIGN PATENT DOCUMENTS

CN 1096572 12/1994
CN 103153112 6/2013
(Continued)

OTHER PUBLICATIONS 201380027473.4, Aug. 25, 2015, Chinese Office Action and English Translation.

*Primary Examiner* — Robert J Sandy
*Assistant Examiner* — Rowland Do
(74) *Attorney, Agent, or Firm* — Workman Nydegger

(57) ABSTRACT

A shoelace winding reel for a shoelace winding device that is compact and light weight, with superior durability and assembly workability. The shoelace winding reel is housed in a reel storing section of a base member and is configured to be rotatively driven by a dial. The shoelace winding reel includes a rotation shaft portion arranged on an inner side of the shoelace winding drum and an annular portion configured to connect an inner circumferential surface of the shoelace winding drum and an outer circumferential surface of the rotation shaft portion. An annular groove portion is configured to sandwich a tip end portion of the shoelace.

4 Claims, 4 Drawing Sheets

(58) Field of Classification Search
CPC . Y10T 24/2187; Y10T 24/4984; Y10T 24/37; Y10T 74/2133; B65H 75/4431
See application file for complete search history.

(56) References Cited

U.S. PATENT DOCUMENTS

| | | | | |
|---|---|---|---|---|
| 5,157,813 | A * | 10/1992 | Carroll | A43C 7/00 24/68 B |
| 5,325,613 | A | 7/1994 | Sussmann | |
| 5,606,778 | A | 3/1997 | Jungkind | |
| 5,934,599 | A | 8/1999 | Hammerslag | |
| 6,202,953 | B1 | 3/2001 | Hammerslag | |
| 6,289,558 | B1 | 9/2001 | Hammerslag | |
| 7,954,204 | B2 | 6/2011 | Hammerslag et al. | |
| 8,245,371 | B2 * | 8/2012 | Chen | A43C 7/00 24/68 B |
| 8,308,098 | B2 * | 11/2012 | Chen | A43C 7/00 24/68 SK |
| 8,353,087 | B2 | 1/2013 | Chen | |
| 8,468,657 | B2 | 6/2013 | Soderberg et al. | |
| 8,516,662 | B2 | 8/2013 | Goodman et al. | |
| 8,707,486 | B2 | 4/2014 | Chella et al. | |
| 8,832,912 | B2 * | 9/2014 | Ha | A43C 11/165 24/68 B |
| 9,072,341 | B2 * | 7/2015 | Jungkind | A43C 11/165 |
| 9,101,181 | B2 | 8/2015 | Soderberg et al. | |
| 9,339,089 | B2 | 5/2016 | So | |
| 9,364,054 | B2 | 6/2016 | Gittens et al. | |
| 9,375,053 | B2 * | 6/2016 | Burns | A43C 11/165 |
| 9,408,437 | B2 * | 8/2016 | Goodman | A43C 11/165 |
| 9,408,438 | B2 * | 8/2016 | Chen | A43C 7/02 |
| 9,439,477 | B2 | 9/2016 | Neiley | |
| 2002/0178548 | A1 * | 12/2002 | Freed | A43C 11/08 24/19 |
| 2005/0247813 | A1 | 11/2005 | Kovacevich et al. | |
| 2006/0156517 | A1 | 7/2006 | Hammerslag et al. | |
| 2007/0169378 | A1 * | 7/2007 | Sodeberg | A43C 1/00 36/50.5 |
| 2009/0172928 | A1 | 7/2009 | Messmer et al. | |
| 2009/0184189 | A1 * | 7/2009 | Soderberg | A43B 3/0042 242/395 |
| 2010/0101061 | A1 * | 4/2010 | Ha | A43B 3/0042 24/712.5 |
| 2010/0139057 | A1 | 6/2010 | Soderberg et al. | |
| 2010/0299959 | A1 * | 12/2010 | Hammerslag | A43B 5/1666 36/50.5 |
| 2011/0167543 | A1 * | 7/2011 | Kovacevich | A42B 3/145 2/417 |
| 2011/0191992 | A1 | 8/2011 | Chen | |
| 2011/0266384 | A1 | 11/2011 | Goodman et al. | |
| 2012/0004587 | A1 * | 1/2012 | Nickel | A61F 5/0118 602/21 |
| 2013/0025100 | A1 | 1/2013 | Ha | |
| 2014/0097283 | A1 | 4/2014 | So | |
| 2014/0117140 | A1 | 5/2014 | Goodman et al. | |
| 2016/0213099 | A1 * | 7/2016 | Ha | A43C 11/165 |

FOREIGN PATENT DOCUMENTS

| | | | |
|---|---|---|---|
| EP | 0056953 | | 11/1985 |
| EP | 0412290 | | 6/1994 |
| EP | 0651954 | A1 | 5/1995 |
| EP | 0625015 | | 7/1996 |
| JP | 54-108125 | U | 7/1979 |
| JP | 4171774 | B2 | 9/2001 |
| JP | 2009-504210 | | 2/2009 |
| JP | 2010-148927 | A | 7/2010 |
| JP | 4538836 | B2 | 7/2010 |
| JP | 2012-120679 | A | 6/2012 |
| JP | 2013-22467 | | 2/2013 |
| JP | 2013-525007 | | 6/2013 |
| WO | WO 99/09850 | A1 | 3/1999 |
| WO | WO 01/15559 | | 3/2001 |
| WO | WO 2005/013748 | A1 | 2/2005 |
| WO | WO 2006/050266 | A2 | 5/2006 |
| WO | WO 2010/059989 | A2 | 5/2010 |
| WO | WO 2010/059989 | A3 | 5/2010 |
| WO | WO 2011/137405 | A2 | 11/2011 |
| WO | 2012/165803 | | 12/2012 |

* cited by examiner

SHOELACE WINDING REEL

CROSS REFERENCE TO RELATED APPLICATIONS

This application is a U.S. Nationalization of PCT Application Number PCT/JP2013/078117, filed on Oct. 17, 2013, which claims priority to Japanese Patent Application No. 2013-127612, filed on Jun. 18, 2013, the entireties of which are incorporated herein by reference. This application is related to U.S. application Ser. No. 14/405,733, filed Dec. 4, 2014.

TECHNICAL FIELD

The present invention relates to a shoelace winding reel installed in a shoelace winding device, and relates to a shoelace winding reel that is suitable not only for boots for skiing, snowboarding, skating, mountain climbing, and biking, but also for sports shoes used in golf and jogging, and moreover suitable for tightening shoelaces of general shoes such as business shoes.

BACKGROUND ART

Conventionally, to tighten a boot shoelace used in skiing, snowboarding, skating and the like, a shoelace winding device that can wind up the shoelace by rotating a dial (disk-shaped tab) has been proposed (Patent Documents 1, 2, and 3).

As a shoelace to be used for such shoelace winding devices, a wire-shaped shoelace formed of a composite material of resin and metal, having superior strength and low friction coefficient, and being smooth is used, and both end portions of such a shoelace are fixed to a shoelace winding reel installed in a shoelace winding device.

Accordingly, in order to fix such a shoelace by tying the same onto the shoelace winding reel, the end portions of the shoelace need to be long enough so that the end portions of the shoelace does not come off the reel even when the shoelace is tightened strongly.

However, a gear mechanism for winding up the shoelace, a lock mechanism for retaining the shoelace in a wound-up state, a mechanism for releasing the lock and the like are housed inside the shoelace winding device, and there is a problem of an occurrence of hindrance to operation of the shoelace winding device by the end portions of the shoelace sticking out from the shoelace winding reel to interfere with the internal mechanisms, and that a device easily breaks.

Especially, such a problem becomes more serious by reducing a size of the shoelace winding device that uses the wire-shaped shoelace having low friction coefficient and being smooth, and it is an obstacle to the size reduction of the shoelace winding device.

Moreover, in such a shoelace winding reel installed in a shoelace winding device, size reduction and durability improvement as well as simplification of an assembling work are being required, and resolution of these problems is necessary in order to employ the shoelace winding device to an even greater variety of shoes.

CITATION LIST

Patent Literatures

Patent Document 1: JP 4171774 B
Patent Document 2: JP 4538836 B

Patent Document 3: JP 2010-148927 A

SUMMARY OF INVENTION

Technical Problem

Thus, the present invention aims to solve the problem that there are cases where hindrance to the operation of the shoelace winding device occurs by the end portions of the shoelace sticking out of the shoelace winding reel to interfere with the internal mechanisms, and that the device easily breaks, and this degrades durability and reliability of the shoelace winding device. The purpose of the present invention is to provide a shoelace winding reel housed in a shoelace winding device which facilitates assembling work, can be used for various types of shoes, can simply and surely fix the end portions of the shoelace to the shoelace winding reel, and improves size reduction and durability of the shoelace winding device and the shoelace winding reel.

Solution to Problem

The present invention has a most primary feature in "a shoelace winding reel to be housed in a reel storing section of a base member to be fixed to a shoe, and configured to be rotatively driven by a dial, the shoelace winding reel comprising: a shoelace winding drum configured of a cylindrical body having a large diameter for winding up a wire-shaped shoelace formed of resin, metal, or a composite material thereof, and flange portions formed at both end portions of the cylindrical body; a rotation shaft portion configured of a cylindrical body having a small diameter arranged on an inner side of the shoelace winding drum; an annular portion configured to connect an inner circumferential surface of the shoelace winding drum and an outer circumferential surface of the rotation shaft portion; and an annular groove portion formed by the shoelace winding drum, the rotation shaft portion, and the annular portion, wherein an engagement projection is provided in the groove portion, the engagement projection being configured to sandwich a tip end portion of the shoelace guided into the groove portion from an outer circumferential surface side of the shoelace winding drum to retain the tip end portion within the groove portion".

The engagement projection may be projectingly provided from the inner circumferential surface of the shoelace winding drum into the groove portion, and may be configured to sandwich the shoelace between the engagement projection itself and the rotation shaft portion.

The shoelace winding drum may have a wire insertion hole penetratingly provided on the cylindrical body, and the engagement projection may retain a tip end side of the shoelace inserted in the wire insertion hole.

Further, in the shoelace winding reel, a slope configured to guide the tip end side of the shoelace inserted in the wire insertion hole may be formed in the groove portion along the inner circumferential surface of the shoelace winding drum or along the outer circumferential surface of the rotation shaft portion.

Moreover, one engagement projection may be provided at each of positions separated apart by about 180 degrees in the groove portion, the wire insertion hole may be arranged between the engagement projections, and the slope may be arranged at positions between the wire insertion hole and the engagement projections.

Advantageous Effects of Invention

In the shoelace winding reel of the present invention configured as above, the end portion of the shoelace can easily and surely be retained in the groove portion by the engagement projections provided in the groove portion, and the end portion of the shoelace can be prevented from coming off the shoelace winding drum.

Moreover, since the end portion of the shoelace does not need to be long, occurrence of hindrance to operation of the shoelace winding device by the end portion of the shoelace sticking out of the shoelace winding reel to interfere with the internal mechanisms of the shoelace winding device, and breakage of the device can surely be prevented.

Thus, the size and weight reduction and improvement of reliability and durability of the shoelace winding device can be achieved.

By configuring the engagement projection to be projectingly provided from the inner circumferential surface of the shoelace winding drum into the groove portion and to allow the shoelace to be sandwiched between the engagement projection and the rotation shaft portion, the end portion of the shoelace can be retained in the groove portion of the shoelace winding reel with excellent accommodating performance.

By penetratingly providing the wire insertion hole on the cylindrical body of the shoelace winding drum and retaining the tip end side of the shoelace inserted in the wire insertion hole by the engagement projection, not only an attached state of the shoelace onto the shoelace winding reel can be made firm, but also attaching work efficiency can be made superior.

Further, by forming the slope configured to guide the tip end side of the shoelace inserted in the wire insertion hole in the groove portion, the efficiency of the work to draw out the end portion of the shoelace from the shoelace winding reel, inserting the shoelace in the wire insertion hole, and tying the same can further be improved.

By providing one engagement projection at each of the positions separated apart by about 180 degrees in the groove portion, arranging the wire insertion hole between them, and arranging the slope at positions between the wire insertion hole and the engagement projections, the attachment of the shoelace to the shoelace winding reel can be performed with good balance, and the shoelace winding device can further be reduced in size and weight with excellent reliability and durability.

DESCRIPTION OF EMBODIMENTS

The present invention is "a shoelace winding reel to be housed in a reel storing section of a base member to be fixed to a shoe, and configured to be rotatively driven by a dial, the shoelace winding reel comprising: a shoelace winding drum configured of a cylindrical body having a large diameter for winding up a wire-shaped shoelace formed of resin, metal, or a composite material thereof, and flange portions formed at both end portions of the cylindrical body; a rotation shaft portion configured of a cylindrical body having a small diameter arranged on an inner side of the shoelace winding drum; an annular portion configured to connect an inner circumferential surface of the shoelace winding drum and an outer circumferential surface of the rotation shaft portion; and an annular groove portion formed by the shoelace winding drum, the rotation shaft portion, and the annular portion, wherein an engagement projection is provided in the groove portion, the engagement projection being configured to sandwich a tip end portion of the shoelace guided into the groove portion from an outer circumferential surface side of the shoelace winding drum to retain the tip end portion within the groove portion", and can suitably be implemented by embodiments and the like described hereinbelow.

Hereinafter, an embodiment in which the shoelace winding device having the shoelace winding reel of the present invention is attached in sports shoes will be described.

Figure 1:
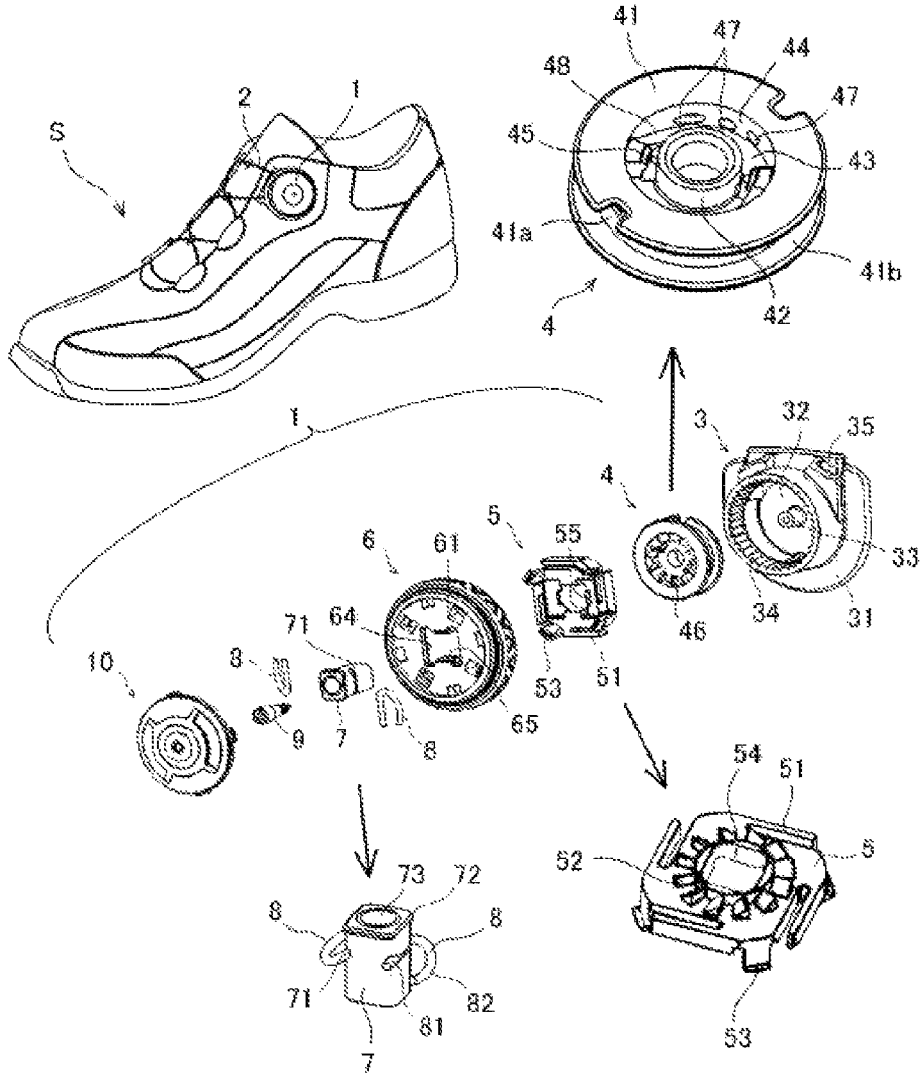
FIG. 1 is a perspective view of a shoe on which a shoelace winding device installed with a shoelace winding reel embodying the present invention is attached, and a perspective view of configurational components of the shoelace winding device.
Figure 2:
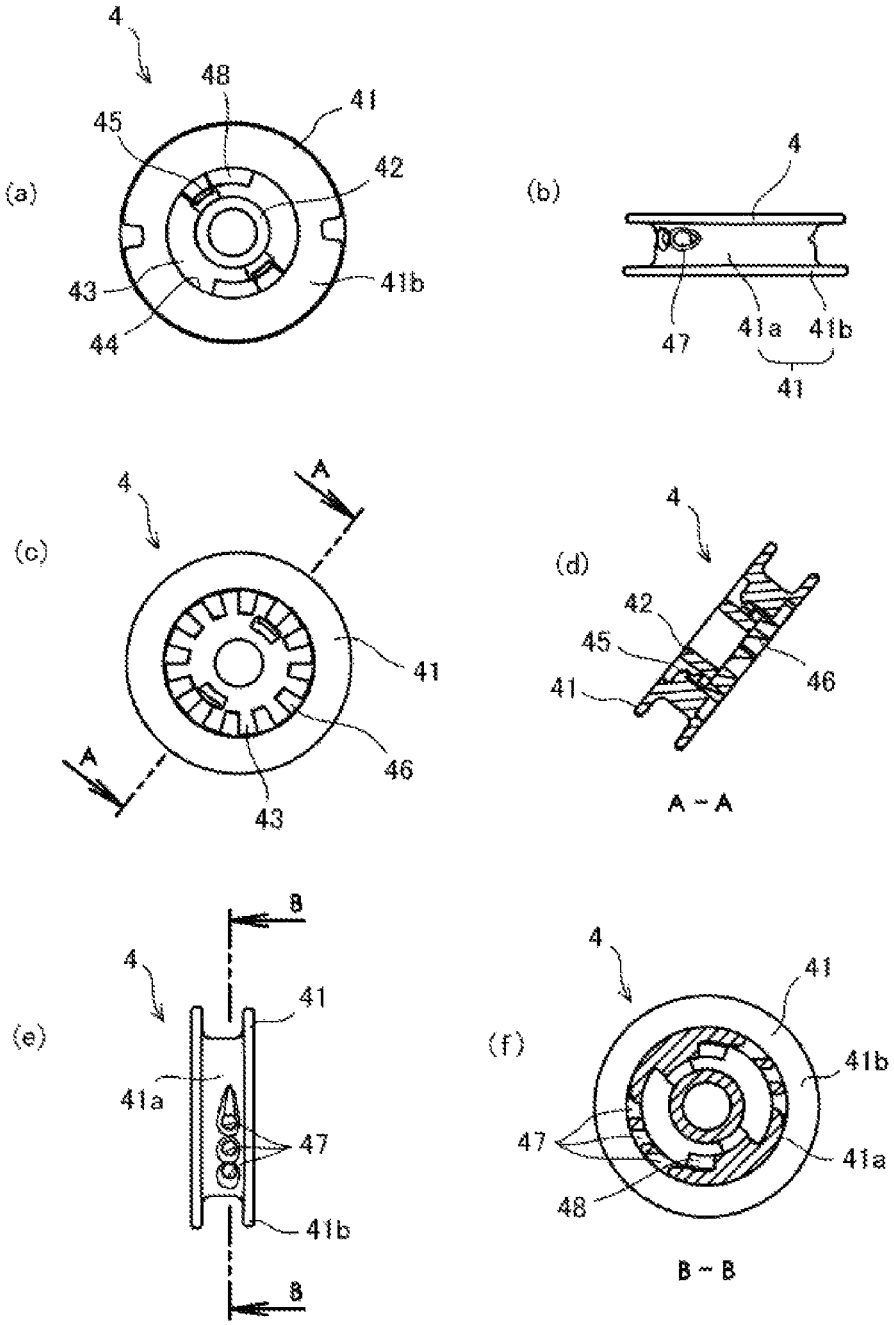
FIGS. 2(*a*) to 2(*f*) show the shoelace winding reel installed in the shoelace winding device embodying the present invention, where 2(*a*) is a front view, 2(*b*) is a plan view, 2(*c*) is a rear view, 2(*d*) is an A-A cross sectional view, 2(*e*) is a lateral view, and 2(*f*) is a B-B cross sectional view.
Figure 3:
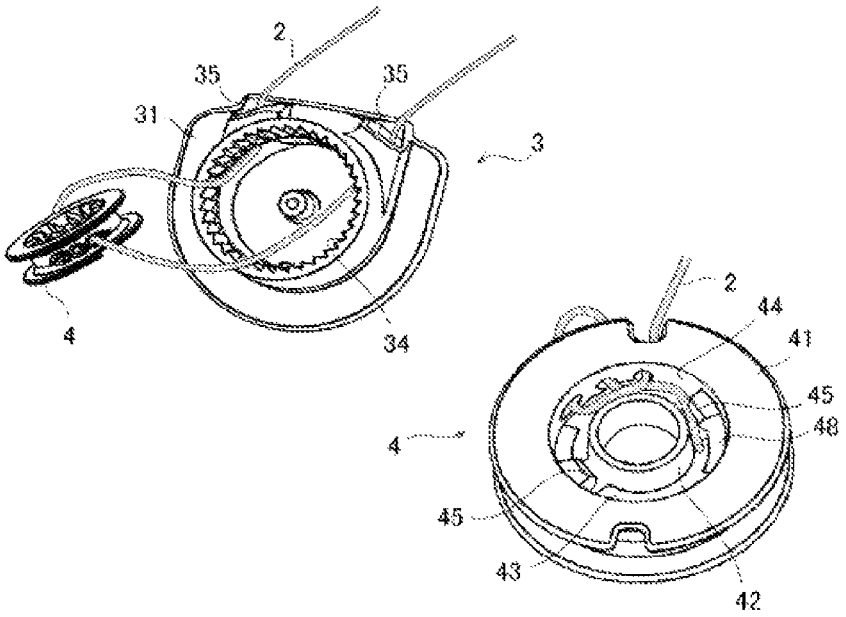
FIG. 3 is a perspective view of a base member of the shoelace winding device, and a shoelace winding reel embodying the present invention.

FIG. 1 shows a shoe S equipped with a shoelace winding device 1 at a position corresponding to an ankle, and this shoe S is configured such that an instep portion of the shoe S can be tightened by the shoelace 2 configured of a resin-coated metal wire.

The shoelace winding device 1 is configured of a base member 3, a shoelace winding reel 4 for winding the shoelace 2, a stopper member 5 for controlling rotation and stop of the shoelace winding reel 4, a dial 6 for rotatively driving the shoelace winding reel 4, a shaft member 7 to be rotatably fixed to the base member 3 for attaching the dial 6 and the stopper member 5 onto the base member 3, a spring member 8 having its one end portion axially supported by the shaft member 7, and the like.

The base member 3 can fix the shoelace winding device 1 to the shoe S by having a thin plate-shaped U-shaped flange 31 sewn onto the shoe S and fixed thereto, and includes a bottomed cylindrical-shaped reel storing section 32 for rotatably storing the shoelace winding reel 4.

The reel storing section 32 has a rotation shaft 33 for axially supporting the shoelace winding reel 4 projectingly formed at its bottom center, and a gear 34 is formed on an inner circumferential surface thereof.

The gear 34 configures a ratchet mechanism by cooperating with claws 51 formed on the stopper member 5, and has a cross section formed in a shape of "saw-teeth" so that the claws 51 can only move in a direction to wind the shoelace 2 (forward rotation).

Further, the base member 3 has shoelace draw-out openings 35 opened to a bottom of the reel storing section 32 and formed at two portions, and the shoelace 2 wound on the shoelace winding reel 4 can be drawn outside from the reel storing section 32.

The shoelace winding reel 4 includes a shoelace winding drum 41 for winding the shoelace 2, a rotation shaft portion 42 arranged on an inner side of the shoelace winding drum 41, an annular portion 43 connecting an inner circumferential surface of the shoelace winding drum 41 and an outer circumferential surface of the rotation shaft portion 42, and an annular groove portion 44 formed by the shoelace winding drum 41, the rotation shaft portion 42, and the annular portion 43.

The shoelace winding drum 41 is configured of a cylindrical body 41*a* having a large diameter for winding up the shoelace 2, and flange portions 41*b* formed at both end portions of the cylindrical body 41*a*, and the rotation shaft portion 42 is configured of a cylindrical body having a small diameter arranged on an inner side of the shoelace winding drum 41.

The rotation shaft 33 of the base member 3 is inserted to an inner surface side of the rotation shaft portion 42, and the shoelace winding reel 4 is rotatable within the reel storing section 32.

The groove portion 44 of the reel 4 is arranged on a side facing the bottom of the vase member 3 (hereafter referred to as a "lower side", and an opposite side thereof as an "upper side" for the sake of convenience of explanation), and engagement projections 45 for clamping a distal end of the shoelace 2 to be guided in the groove portion 44 from an outer circumferential surface side of the shoelace winding drum 41 and retaining the same in the groove portion 44 are provided within the groove portion 44.

The engagement projections 45 are projectingly provided from an inner circumferential surface of the shoelace winding drum 41 at positions in the vicinity of an upper edge of the groove portion 44 to an inside of the groove portion 44, and are configured to sandwich the shoelace 2 between themselves and the rotation shaft portion 42, pressing the shoelace 2 toward a bottom portion side (annular portion 43 side) of the groove portion 44, and retaining the same.

The shoelace winding reel 4 has a slope 48 that guides a distal end of the shoelace 2 inserted through the wire insertion holes 47 toward an axially outer side (upper side of the groove portion 44) formed in the groove portion 44 along the inner circumferential surface of the shoelace winding drum 41.

The engagement projection 45 is provided respectively at positions that are about 180 degrees apart in the groove portion 44, three wire insertion holes 47 are arranged between them, and the slope 48 is arranged at a position between the wire insertion holes 47 and the engagement projections 45.

A plurality of fins 46 is formed along the inner circumferential surface of the shoelace winding drum 41 on the upper side of the shoelace winding reel 4, and they can transmit the rotation of the dial 6 to the shoelace winding reel 4 by meshing with fins 52 formed on the lower side of the stopper member 5.

The stopper member 5 is integrated with the dial 6 by engaging with an inner side (lower side) of the dial 6 with attachment claw portions 53 formed at its four corners being engaged with engagement holes 61 formed through the dial 6, and it can realize the lock state in which the rotation of the dial 6 can be transmitted to the shoelace winding reel 4 by being intervened between the shoelace winding reel 4 and the dial 6, and the release state in which the shoelace winding reel 4 is disconnected from the dial 6 so that the reel 4 can freely rotate.

The shaft member 7 is fixed to the base member 3 by a screw 9 so as to rotatably attach the integrated dial 6 and stopper member 5 onto the base member 3, and it can retain and guide the integrated dial 6 and stopper member 5 in a state of being movable between the lock position in which the integrated dial 6 and stopper member 5 are set close to the base member 3 and the release position in which they are separated from the base member 3.

The shaft member 7 is formed in a square column shape, and axially supports the spring members 8 in a rotatable manner by one end portion which is linear-shaped (a shaft portion 81) and is formed on the spring members 8 being inserted into bearing sections 71 formed by cutting out two opposing side portions of the shaft member in a direction orthogonally intersecting an axial direction of the shaft member 7. That is, the spring members 8 are arranged one each at positions of the shaft member 7 that are separated about 180 degrees apart.

Further, due to the shaft member 7 being in the square column shape, the strength of the bearing sections 71 can be increased, which can contribute to making the size of the shaft member 7 compact.

Moreover, the bearing sections 71 of the shaft member 7 are formed with their inner diameter in the vicinity of their center portions to be the smallest for easy separation from a mold.

Each spring member 8 has its entirety formed by being curved in a substantially U shape, and a curved spring portion 82 on the other end makes contact with an engaging portion 62 provided on an inner surface of the integrated dial 6 and stopper member 5.

The engaging portion 62 where the other end portion (spring portion 82) of the spring member 8 makes contact is provided at an outer end narrowest portion of a spring storing space 63 formed in a cuneate shape at a boundary portion between the dial 6 and the stopper member 5.

Further, the shoelace winding reel 4 can be switched from a lock state to a release state by the integrated dial 6 and stopper member 5 being moved from the lock position to the release position.

Moreover, an inversion position where the spring portions 82 of the spring members 8 are most compressed toward the shaft member side is set to be present at a position between the lock position and the release position.

A disk-shaped cap 10 is engaged with an upper side of the dial 6 so that dust and the like do not enter the inside of the shoelace winding device 1.

Meanwhile, a through hole 11 is formed at a center portion of the cap 10, and the shoelace winding reel 4, the dial 6, and the shaft member 7 can be disassembled from the base member 3 by operating the screw 9 within the inner side (lower side) of the cap 10 through this through hole 11.

As the wire-shaped shoelace 2 formed of a composite material of resin and metal, a wire rope in which 49 strings of stainless wires with a diameter of 0.11 to 0.13 mm are twisted that is processed by a swaging machine and coated by nylon resin can suitably be used.

Next, a method of manufacturing the shoelace winding device 1 described above by assembling the respective components will be described.

Firstly, in order to attach the shoelace winding reel 4 to the base member 3 of the shoelace winding device 1, tip ends of the shoelace 2 are inserted to the shoelace draw-out openings 35 provided at two positions, and the both ends of the shoelace 2 are drawn out from the reel storing section 32 side.

Further, the tip ends of the shoelace 2 are sequentially inserted into the wire insertion holes 47 provided at six positions on the shoelace winding reel 4 in a sewing manner, and are further sandwiched by the engagement projections 45 of the groove portion 44, whereby the both ends of the shoelace 2 can simply and surely be fixed to the shoelace winding reel 4. Thereafter, the shoelace winding reel 4 is arranged inside the reel storing section 32.

Figure 4:
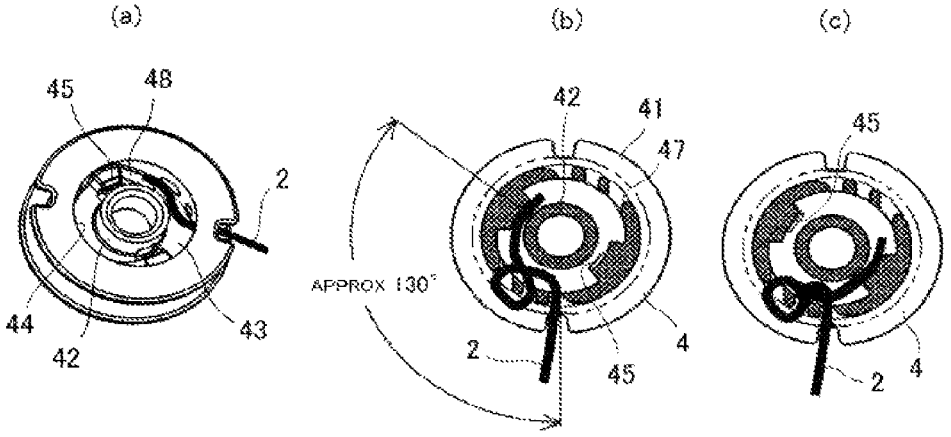
FIGS. 4(*a*) to 4(*c*) show the shoelace winding reel embodying the present invention and end portions of the shoelace, where 4(*a*) is a perspective view, and 4(*b*) and 4(*c*) are cross sectional views.

As a method for inserting the shoelace 2 through the wire insertion holes 47, for example, a method shown in FIG. 4(*b*) and a method shown in FIG. 4(*c*) can be exemplified.

By way of either method, as the tip end of the shoelace 2 inserted into a wire insertion hole 47 is guided to the axially outer side of the shoelace winding reel 4 by the slope 48, that is, to the outside of the groove portion 44, a work to insert the tip end of the shoelace 2 to the subsequent wire insertion hole 47 can be performed promptly.

Next, the stopper member 5 and the dial 6 are integrated by engaging the stopper member 5 to the inner side (lower side) of the dial 6, and the shaft member 7 and the spring members 8 are assembled thereto.

In this case, the shaft member 7 is inserted into a substantially square-shaped axial hole 64 formed in the dial 6 and a substantially square-shaped axial hole 54 formed in the stopper member 5, whereas the spring portions 82 of the spring members 8 are inserted into spring storing spaces 63 from expanded portions where the axial hole 64 of the dial 6 is expanded, and moreover the spring portion 82 is guided to rotatingly move to the outer end narrowest portion side from the inner end side of the spring storing space 63, and is assembled to the dial 6.

Meanwhile, a flange 72 formed at an upper end portion of the shaft member 7 makes contact with an engaging step portion 65 formed at an edge of the axial hole 64 of the dial 6, whereby the dial 6 does not come off the shaft member 7.

The spring portions 82 of the spring members 8 being guided to rotatingly move from the inner end side of the spring storing spaces 63 toward the outer end narrowest portion side is realized because an angled surface 55 facing an upper side (dial side) is formed at an edge of the axial hole 54 of the stopper member 5.

After having assembled the stopper member 5, the dial 6, the shaft member 7, and the spring members 8 by the above procedures, the screw 9 is inserted into a screw insertion hole 73 penetratingly formed along an axis of the shaft member 7, and the shaft member 7 and the other parts are attached to the base member 3.

The shoelace winding device 1 can be assembled by fitting the cap 10 onto the dial 6 at last.

In disassembling the shoelace winding device 1 for maintenance or repair, a screwdriver is inserted from the through hole 11 of the cap 10 and the screw 9 is taken off, whereby the stopper member 5, the dial 6, the shaft member 7, and the spring members 8 that were assembled can be taken off from the base member 3.

As cases where the maintenance or repair is necessary, a case where the shoelace 2 has been torn and a case where the shoelace 2 is entangled within the reel storing section 32 are most likely to happen, so being able to disconnect the stopper member 5, the dial 6, the shaft member 7, and the spring members 8 while they are being assembled from the base member 3 is very effective in improving the efficiency of the maintenance or repair work.

Meanwhile, as materials configuring the respective components in the shoelace winding device 1 of the present embodiment, the followings were used as an example in consideration of their strength, durability, elasticity and the like; however, materials are not limited thereto.

Base member 3: Nylon

Shoelace Winding Reel 4, stopper member 5, and shaft member 7: POM (polyacetal)

Dial 6: Nylon and TPE (thermoplastic elastomer) at a periphery thereof

Spring members 8: Stainless steel

Screw 9: Carbon steel

Cap 10: ABS resin

A method of use of the shoelace winding device 1 configured as above will be described.

In order to tighten the shoelace 2 after the shoe S is worn, the dial 6 of the shoelace winding device 1 is operated to rotate at the lock position where the dial 6 is caused to approach the base member 3, and the shoelace 2 is wound on the shoelace winding reel 4 thereby.

In this case, the shoelace winding reel 4 does not rotate in a direction with which the shoelace 2 is loosened by the claws 51 of the stopper member 5 making contact with the gear 34.

Figure 5:
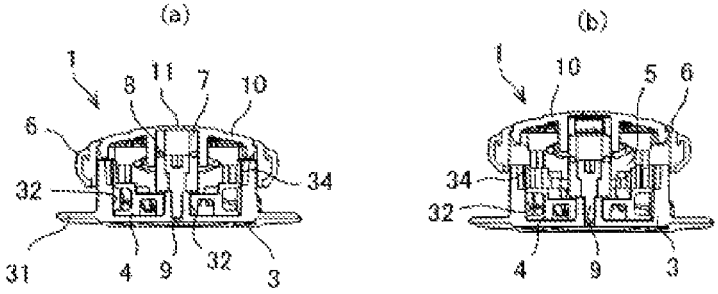
FIGS. 5(*a*) and 5(*b*) are perspective views of the shoelace winding device installed with the shoelace winding reel embodying the present invention, where 5(*a*) is a cross sectional view showing a state in which a dial is in a lock position, and 5(*b*) is a cross sectional view showing a state in which the dial is in a release position.
Figure 6:
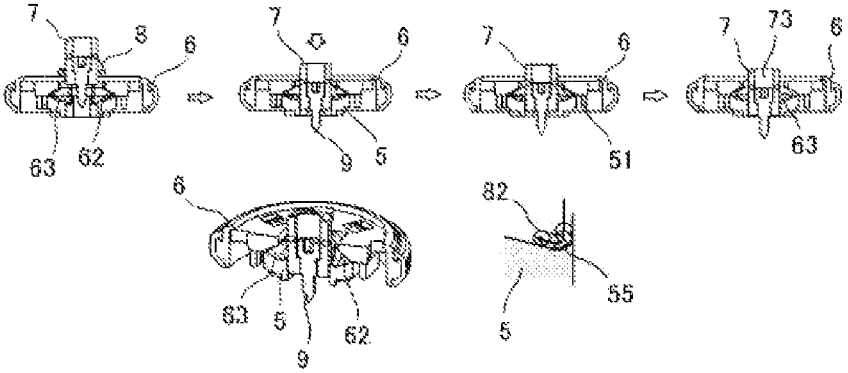
FIG. 6 is a cross sectional view showing a manner upon when a shaft member is assembled onto the dial of the shoelace winding device installed with the shoelace winding reel embodying the present invention.

Further, since the inversion position where the spring members 8 are compressed the most is set at the position between the lock position and the release position, the spring members 8 are in the state shown in left side of FIG. 5 when the dial 6 is in the lock position, wherein the dial 6 is retained in the lock position.

At this occasion, the spring members 8 are oriented in a direction along which the shaft member 7 is lifted and the dial 6 is pressed down.

Next, in order to loosen the tightened shoelace 2, the dial 6 of the shoelace winding device 1 is pulled to the upper side.

At this occasion, the spring members 8 are compressed, and by further pulling the dial 6 to the upper side against the repelling force thereof, the spring members 8 go beyond the inversion position where they are compressed the most, the direction toward which the spring members 8 are compressed switches between the lock position and the release position, whereby the dial 6 is moved to the release position separated away from the base member 3 (state shown in right side of FIG. 5).

At this occasion, the spring members 8 are oriented in a direction along which the shaft member 7 is pressed down and the dial 6 is lifted.

The other end portions (spring portions 82) of the spring members 8 are making constant contact with the engaging portions 62 provided on the inner surface of the dial 6, whereby the wear of the components can be prevented.

Since the spring members 8 switch clearly between the lock position and the release position, not only the operability is improved, but also it is easy to understand the state of the position where the dial 6 resides.

As above, when the dial 6 moves from the lock position to the release position, engagement between the fins 46 of the shoelace winding reel 4 and the fins 52 of the stopper member 5 is released, whereby the shoelace winding reel 4 becomes freely rotatable, and the shoelace 2 is loosened thereby.

By contrast, if the dial 6 is pressed down so as to move from the release position to the lock position, the spring members 8 go, in the opposite direction, beyond the inversion position where they are compressed the most, and the fins 46 of the shoelace winding reel 4 and the fins 52 of the stopper member 5 again engage with one another; thus the shoelace 2 can be tightened by winding the shoelace 2 onto the shoelace winding reel 4.

Meanwhile, in the description, a shape of the "dial" is not specifically limited so long as it functions as an operating section for rotatively driving the shoelace winding reel 4, and it may have a polygonal shape.

The present invention is not limited to the shoelace winding reel for the shoelace winding device 1 for tightening the shoelace 2 arranged as in the configuration shown in the drawings, and may be embodied as a component to be installed in a shoelace winding device for tightening a shoelace 2 which tightens a different portion of the shoe S.

Furthermore, implementations can be made while suitably making changes to materials, shapes, dimensions, angles, arranged positions, sizes, numbers and the like of the respective parts of the shoelace winding device and the shoelace winding reel.

For example, implementations may be made by projectingly providing the engagement projections 45 in the groove portion 44 from the rotation shaft portion 42 side, and further implementations may be made by providing the slope 48 so as to be along an outer circumferential surface of the rotation shaft portion 42.

INDUSTRIAL APPLICABILITY

The present invention is small-sized and light weight, has superior durability and assembly workability, and can suitably be used as a shoelace winding reel to be installed in a shoelace winding device that can conveniently be used in various types of shoes.

REFERENCE SIGNS LIST

1 Shoelace Winding Device
2 Shoelace
3 Base Member
31 Flange
32 Reel Storing Section
33 Rotation Shaft
34 Gear
35 Shoelace Draw-out Opening
4 Shoelace Winding Reel
41 Shoelace Winding Drum
41*a* Cylindrical Body
41*b* Flange Portion
42 Rotation Shaft Portion
43 Annular Portion
44 Groove Portion
45 Engagement Projection
46 Fin
47 Wire Insertion Hole
48 Slope
5 Stopper Member
51 Claw
52 Fin
53 Attachment Claw Portion
54 Axial Hole
55 Angled Surface
6 Dial
61 Engagement Hole
62 Engaging Portion
63 Spring Storing Space
64 Axial Hole
65 Engaging Step Portion
7 Shaft Member
71 Bearing Section
72 Flange
73 Screw Insertion Hole
8 Spring Member
81 Shaft Portion (one end portion)
82 Spring Portion (the other end portion)
9 Screw
10 Cap
11 Through Hole
S Shoe

The invention claimed is:

1. A shoelace winding reel to be housed in a reel storing section of a base member to be fixed to a shoe, and configured to be rotatively driven by a dial, the shoelace winding reel comprising:

a shoelace winding drum configured of a cylindrical body having a large diameter for winding up a wire-shaped shoelace formed of resin, metal, or a composite material thereof, and flange portions formed at both end portions of the cylindrical body;

a rotation shaft portion configured of a cylindrical body having a small diameter arranged on an inner side of the shoelace winding drum;

an annular portion configured to connect an inner circumferential surface of the shoelace winding drum and an outer circumferential surface of the rotation shaft portion; and an annular groove portion formed by the shoelace winding drum, the rotation shaft portion, and the annular portion, wherein an engagement projection is provided in the groove portion, the engagement projection being configured to sandwich a tip end portion of the shoelace guided into the groove portion from an outer circumferential surface side of the shoelace winding drum via wire insertion holes penetratingly provided on the large diameter cylindrical body, at a position apart from the holes to retain the tip end portion within the groove portion.

2. The shoelace winding reel according to claim 1, wherein the engagement projection is projectingly provided from the inner circumferential surface of the shoelace winding drum into the groove portion, and is configured to sandwich the shoelace between the engagement projection itself and the rotation shaft portion.

3. The shoelace winding reel according to claim 1, wherein a slope configured to guide the tip end of the shoelace inserted in the wire insertion holes is formed in the groove portion along the inner circumferential surface of the shoelace winding drum or along the outer circumferential surface of the rotation shaft portion.

4. The shoelace winding reel according to claim 1, wherein one engagement projection is provided at each positions separated apart by about 180 degrees in the groove portion, the wire insertion holes are arranged between the engagement projections, and the slope is arranged at positions between the wire insertion holes and the engagement projections.

* * * * *